United States Patent [19]

Nowak et al.

[11] 4,352,411

[45] Oct. 5, 1982

[54] ELEVATOR FLOOR CUTOFF

[75] Inventors: Frederick H. Nowak, Southington; Joseph Bittar, Simsbury, both of Conn.

[73] Assignee: Otis Elevator Company, Farmington, Conn.

[21] Appl. No.: 234,077

[22] Filed: Feb. 13, 1981

[51] Int. Cl.[3] ..... B66B 1/18

[52] U.S. Cl. ..... 187/29 R

[58] Field of Search ..... 187/29

[56] References Cited

U.S. PATENT DOCUMENTS

| | | | |
|---|---|---|---|
| 3,428,148 | 2/1969 | Jacobs | 187/29 |
| 3,586,133 | 6/1971 | Santysiak | 187/29 |
| 4,157,133 | 6/1979 | Corcoran et al. | 187/29 |

*Primary Examiner*—J. V. Truhe

*Assistant Examiner*—W. E. Duncanson, Jr.

*Attorney, Agent, or Firm*—M. P. Williams

[57] ABSTRACT

A microprocessor cab controller for an elevator car processes signals to control car calls by means of routines which prevent car calls from being registered behind the advancing direction of the car unless the car is headed for the lobby without further demand or the car has no advance direction, which respond to directives from a car controller mounted in the building to reset all car calls, reset selected car calls, reset the car call at a floor landing where the car is stopping, or force selected car calls; to inhibit car calls in a selected one of two zones of continuous floors for implementing dual up peak operation, and for selectively inhibiting registration of car calls at floors which are designated as cut off from service by the car. The invention allows the group controller to block or restore response of selected elevators to car calls for specific floors or to restore response of selected elevators to car calls for all floors.

3 Claims, 6 Drawing Figures

ELEVATOR FLOOR CUTOFF

DESCRIPTION

1. Technical Field

This invention relates to elevators, and more particularly to selectively inhibiting car calls to variably designated floors by variably designated cars.

2. Background Art

It is known in elevator systems to provide for floor service cutoff, by means of which one or more elevators are prevented from stopping at one or more designated floor landing in response to passenger-initiated car call requests. Such may be utilized in a multi-function building in which a bank occupies one floor, and the public is excluded from that floor after banking hours. Such may also be utilized to prohibit public access to several floors related to a multi-floor office of a single company, or public access being restricted to the reception floor of that company. In such cases, selective service to such floors may be permitted only in an elevator having limited, keyed access.

In floor cutoff systems known to the prior art, the particular elevators which are to be cut off must be designated on a semipermanent basis, and the floors which are to be cut off with respect to those elevators must also be designated on a semipermanent basis. Thus if the mix of elevators capable of use on a given day is severly altered due to maintenance problems or the like, the overall elevator service for the building can be impaired far beyond the loss of two elevators. Additionally, changes in tenant occupancy of the various floors can require extensive revisions to the elevator control systems in order to accommodate the desired floor cutoff patterns.

DISCLOSURE OF INVENTION

Objects of the invention include provision of a completely dynamically tailorable elevator floor cutoff system, wherein each elevator can be designated at any time to have certain floors cut off therefrom, or have those floors restored.

According to the present invention, each elevator of a system includes a register of cutoff floors designating landings at which such elevator is not permitted to stop in response to passenger-initiated car cells, the register is updated by directives which it receives indicating whether a floor is to be added or deleted from the register of floors, and all registered car calls which correspond to floors designated by the register of cutoff floors in the particular car are canceled so as not to appear on the car call panel indicated within the car and not to be utilized for controlling the performance of the car.

The invention permits sending a directive to any car of a group of cars to either add or subtract from the register of floors which that car cannot provide passenger-initiated car call stops (at which), and the particular set of floors prohibited to any car can be instantaneously updated as desired.

The invention is readily implemented utilizing apparatus and techniques which are well within the skill of the art, in the light of the teachings which follow herein with respect thereto.

Other objects, features and advantages of the present invention will become more apparent in the light of the following detailed description of exemplary embodiments thereof, as illustrated in the accompanying drawings.

BEST MODE FOR CARRYING OUT THE INVENTION

Figure 1:
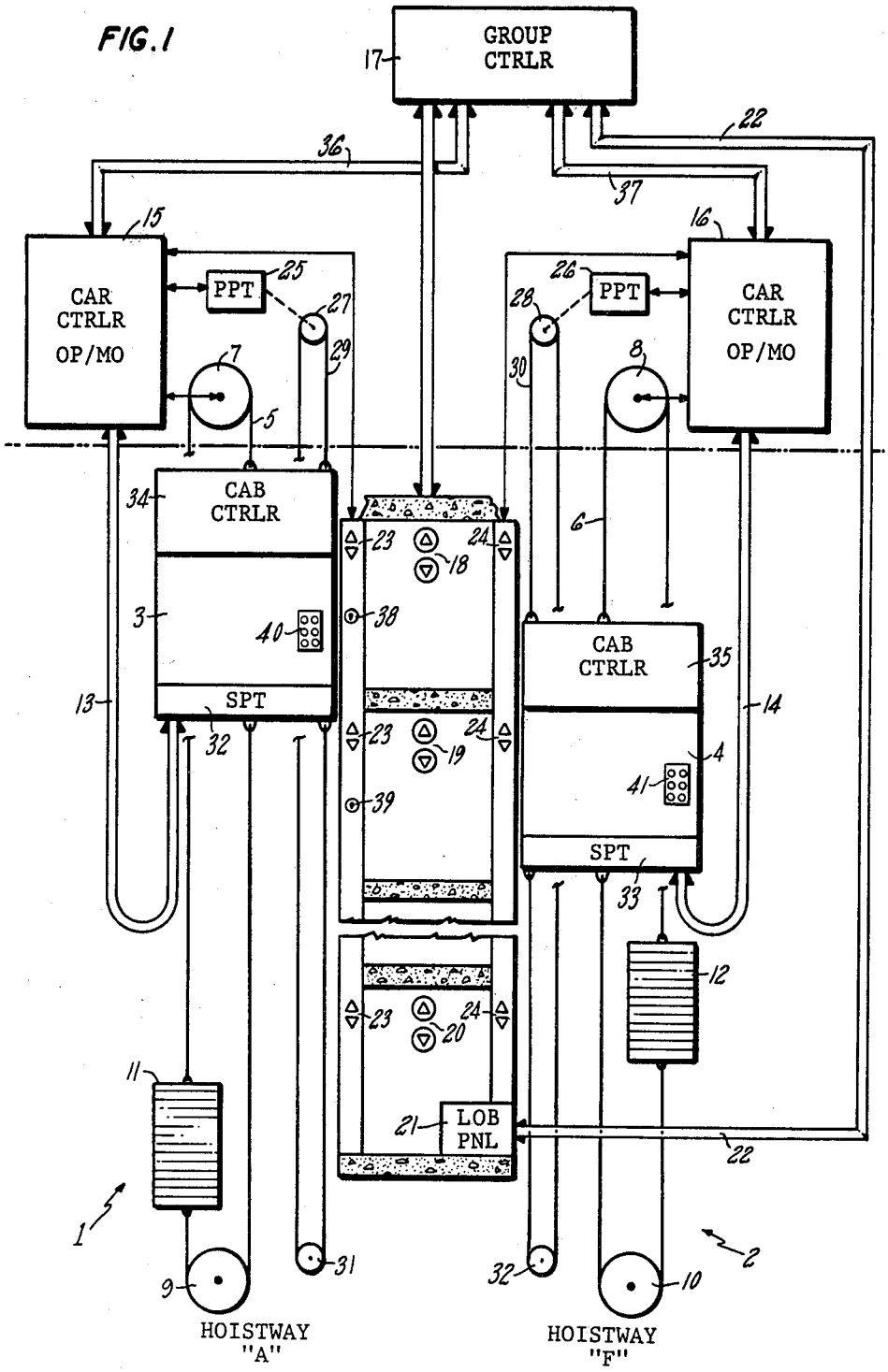
FIG. 1 is a simplified, schematic block diagram, partially broken away, of an elevator system in which the present invention may be incorporated.

A simplified description of a multi-car elevator system, of the type in which the present invention may be practiced, is illustrated in FIG. 1. Therein, a plurality of hoistways, HOISTWAY "A" 1 and HOISTWAY "F" 2 are illustrated, the remainder are not shown for simplicity. In each hoistway, an elevator car or cab 3, 4 is guided for vertical movement on rails (not shown). Each car is suspended on a rop 5, 6 which usually comprises a plurality of steel cables, that is driven in either direction or held in a fixed position by a drive sheave/-motor/brake assembly 7, 8, and guided by an idler or return sheave 9, 10 in the well of the hoistway. The rope 5, 6 normally also carries a counterweight 11, 12 which is typically equal to approximately the weight of the cab when it is carrying half of its permissible load.

Each cab 3, 4 is connected by a traveling cable 13, 14 to a corresponding car controller 15, 16 which is located in a machine room at the head of the hoistways. The car controllers 15, 16 provide operation and motion control to the cabs, as is known in the art. In the case of multi-car elevator systems, it has long been common to provide a group controller 17 which receives up and down hall calls registered on hall call buttons 18–20 on the floors of the buildings, allocates those calls to the various cars for response, and distributes cars among the floors of the building, in accordance with any one of several various modes of group operation. Modes of group operation may be controlled in part by a lobby panel 21 which is normally connected by suitable building wiring 22 to the group controller in multi-car elevator systems.

The car controllers 15, 16 also control certain hoistway functions which relate to the corresponding car, such as the lighting of up and down response lanterns 23, 24, there being one such set of lanterns 23 assigned to each car 3, and similar sets of lanterns 24 for each other car 4, designating the hoistway door where service in response to a hall call will be provided for the respective up and down directions.

The foregoing is a description of an elevator system in general, and, as far as the description goes thus far, is equally descriptive of elevator systems known to the prior art, and elevator systems incorporating the teachings of the present invention.

Although not required in the practice of the present invention, the elevator system in which the invention is utilized may derive the position of the car within the hoistway by means of a primary position transducer (PPT) 25, 26 which may comprise a quasi-absolute, incremental encoder and counting and directional interface circuitry of the type described in a commonly owned copending U.S. patent application of Marvin Masel et al, Ser. No. 927,242, filed on July 21, 1978, (a continuation of Ser. No. 641,798, filed Dec. 18, 1975, now abandoned), entitled HIGH RESOLUTION AND WIDE RANGE SHAFT POSITION TRANSDUCER SYSTEMS. Such transducer is driven by a suitable sprocket 27, 28 in response to a steel tape 29, 30 which is connected at both its ends to the cab and passes over an idler sprocket 31, 32 in the hoistway well. Similarly, although not required in an elevator system to practice the present invention, detailed positional information at each floor, for more door control and for verification of floor position information derived by the PPT 25, 26, may employ a secondary position transducer (SPT) 32, 33 of the type disclosed and claimed in a commonly owned copending U.S. application filed on Nov. 13, 1979, by Fairbrother, Ser. No. 093,475. Or, if desired, the elevator system in which the present invention is practiced may employ inner door zone and outer door zone hoistway switches of the type known in the art.

The foregoing description of FIG. 1 is intended to be very general in nature, and to encompass, although not shown, other system aspects such as shaftway safety switches and the like, which have not been shown herein for simplicity, since they are known in the art and not a part of the invention herein.

All of the functions of the cab itself may be directed, or communicated with, by means of a cab controller 34, 35 which may provide serial, time-multiplexed communications with the car controller as well as direct, hardwire communications with the car controller by means of the traveling cables 13, 14. The cab controller, for instance, will monitor the car call buttons, door open and door close buttons, and other buttons and switches within the car; it will control the lighting of buttons to indicate car calls, and will provide control over the floor indicator inside the car which designates the approaching floor.

The makeup of microcomputer systems, such as may be used in the implementation of the car controllers 15, 16, a group controller 17, and the cab controllers 33, 34, can be selected from readily available components or families thereof, in accordance with known technology as described in various commercial and technical publications. These include "An Introduction to Microcomputers, Volume II, Some Real Products" published in 1977 by Adam Osborne and Associates, Inc., Berkeley, Calif., U.S.A., and available from Sydex, Paris, France; Arrow International, Tokyo, Japan, L. A. Varah Ltd., Vancouver, Canada, and Taiwan Foreign Language Book Publishers Council, Taipei, Taiwan. And, "Digital Microcomputer Handbook", 1977-1978 Second Edition, published by Digital Equipment Corporation, Maynard, Mass., U.S.A. And, Simpson, W. E., Luecke, G., Cannon, D. L., and Clemens, D. H., "9900 Family Systems Design and Data Book", 1978, published by Texas Instruments, Inc., Houston, Tex., U.S.A. (U.S. Library of Congress Catalog No. 78-058005). Similarly, the manner of structuring the software for operation of such computers may take a variety of known forms, employing known principles which are set forth in a variety of publications. One basic fundamental treatise is "The Art of Computer Programming", in seven volumes, by the Addison-Wesley Publishing Company, Inc., Reading, Mass., and Menlo Park, Calif., U.S.A.; London, England; and Don Mills, Ontario, Canada (U.S. Library of Congress Catalog No. 67-26020). A more popular topical publication is "EDN Microprocessor Design Series" published in 1975 by Kahners Publishing Company (Electronic Design News), Boston, Mass., U.S.A. And a useful work is Peatman, J. B., "Microcomputer-Based Design" published in 1977 by McGraw Hill Book Company (worldwide), U.S. Library of Contress Catalog No. 76-29345.

The software structures for implementing the present invention, and peripheral features which may be disclosed herein, may be organized in a wide variety of fashions. However, utilizing the Texas Instruments' 9900 family, and suitable interface modules for working therewith, an elevator control system of the type illustrated in FIG. 1, with separate controllers for the cabs, the cars, and the group, has been implemented utilizing real time interrupts, in which power-on causes a highest priority interrupt which provides system initialization (above and beyond initiation which may be required in any given function of one of the controllers). And, it has employed an executive program which responds to real time interrupts to perform internal program functions and which responds to communication-initiated interrupts from other controllers in order to process serial communications with the other controllers, through the communication register unit function of the processor. The various routines are called in timed, interleaved fashion, some routines being called more frequently than others, in dependence upon the criticality or need for updating the function performed thereby. Specifically, there is no function relating to elevatoring which is not disclosed herein that is not known and easily implemented by those skilled in the elevator art in the light of the teachings herein, nor is there any processor function not disclosed herein which is incapable of implementations using techniques known to those skilled in the processing arts, in the light of the teachings herein.

The invention herein is not concerned with the character of any digital processing equipment, nor is it concerned with the programming of such processor equipment; the invention is disclosed in terms of an implementation which combines the hardware of an elevator system with suitably-programmed processors to perform elevator functions, which have never before been performed. The invention is not related to performing with microprocessors that which may have in the past been performed with traditional relay/switch circuitry nor with hard wired digital modules; the invention concerns new elevator functions, and the disclosure herein is simply illustrative of the best mode contemplated for carrying out the invention, but the invention may also be carried out with other combinations of hardware and software, or by hardware alone, if desired in any given implementation thereof.

Communication between the cab controllers 34, 35, and the car controllers 15, 16 in FIG. 1 is by means of the well known traveling cable in FIG. 1. However, because of the capability of the cab controllers and the car controllers to provide a serial data link between themselves, it is contemplated that serial, time division multiplexed communication, of the type which has been known in the art, will be used between the car and cab controllers. In such case, the serial communication between the cab controllers 33, 34, and the car controllers 15, 16 may be provided via the communication register unit function of the TMS-9900 microprocessor integrated circuit chip family, or equivalent. However, multiplexing to provide serial communications between cab controller and the car controller could be provided in accordance with other teachings, known to the prior art, if desired. The controllers 15, 16, 17, may each be based on a microcomputer which may take any one of a number of well-known forms. For instance, they may be built up of selected integrated circuit chips offered by a variety of manufacturers in related series of integrated circuit chips, such as the Texas Instruments 9900 Family. Such a microcomputer may typically include a microprocessor (a central control and arithmetic and logic unit), such as a TMS 9900 with a TIM 9904 clock, random access memory, a read only memory, an interrupt priority and/or decode circuit, and control circuits, such as address/operation decodes and the like. The microcomputer is generally formed by assemblage of chips on a board, with suitable plated or other wiring so as to provide adequate address, data, and control busses, which interconnect the chips with a plurality of input/output (I/O) modules of a suitable variety. The nature of the I/O modules depends on the functions which they are to control. It also depends, in each case, on the types of interfacing circuitry which may be utilized outboard therefrom, in controlling or monitoring the elevator apparatus to which the I/O is connected. For instance, the I/Os which are connected to car call or hall call buttons and lamps and to switches and indicators may simply comprise buffered input and buffered output, multiplexer and demultiplexer, and voltage and/or power conversion and/or isolation so as to be able to sense cars hall or lobby panel button or switch closure and to drive lamps with a suitable power, whether the power is supplied by the I/O or externally.

An I/O module may provide serial communication over current loop lines 13, 14, 36, 37 between the car controllers 15, 16 and the cab controllers 34, 35 and the group controller 17. These communications include commands from the group controller to the cars such as higher and lower demand, stop commands, cancelling hall calls, preventing lobby dispatch, and other commands relating to features, such as express priority service when requested by a switch 38, 39. These communications also include information concerning car calls, normally requested by buttons in panels 40, 41 exchanged between cab and car controllers as well as the group controller. The group controller initiates communication with each of the car controllers in succession, and each communication operation includes receiving response from the car controllers, such as in the well known "handshake" fashion, including car status and operation information such as whether the car is in the group, is advancing up or down, its load status, its position, whether it is under a go command or is running, whether its door is fully opened or closed, and other conditions. And each car controller 15, 16 engages in similar communication with its own cab controller 34, 35. As described hereinbefore, the meanings of the signals which are not otherwise explained hereinafter, the functions of the signals which are not fully explained hereinafter, and the manner of transferring and utilizing the signals, which are not fully described hereinafter, are all within the skill of the elevator and signal processing arts, in the light of the teachings herein. Therefore, detailed description of any specific apparatus or mode of operation thereof to accomplish these ends is unnecessary and not included herein.

Overall program structure of each controller, based upon a data processing system, in which the present invention may be practiced, is reached through a program entry point as a consequence of power up causing the highest priority interrupt, in a usual fashion. Then a start routine is run in which all RAM memory is cleared, all group outputs are set to zero, and building parameters (which tailor the particular system to the building, and may include such things as floor rise and the like) are read and formatted as necessary, utilizing ordinary techniques. Then the program will advance into the repetitive portion thereof, which, in accordance with the embodiment described herein, may be run on the order of every 200 milliseconds. This portion of the program commences with an initialize routine in which all forcing (FORC) and all inhibit or cancel (INH) functions are cleared from memory; field adjustable variables are read and formatted as necessary; the status of each car is read and formatted as necessary; and all the hall calls and car calls are read, and corresponding button lights for sensed calls are lit. Then, all inputs obtained by communication between the cars, the cabs and the group are distributed to the various maps and other stored parameter locations relating thereto.

Figure 2:
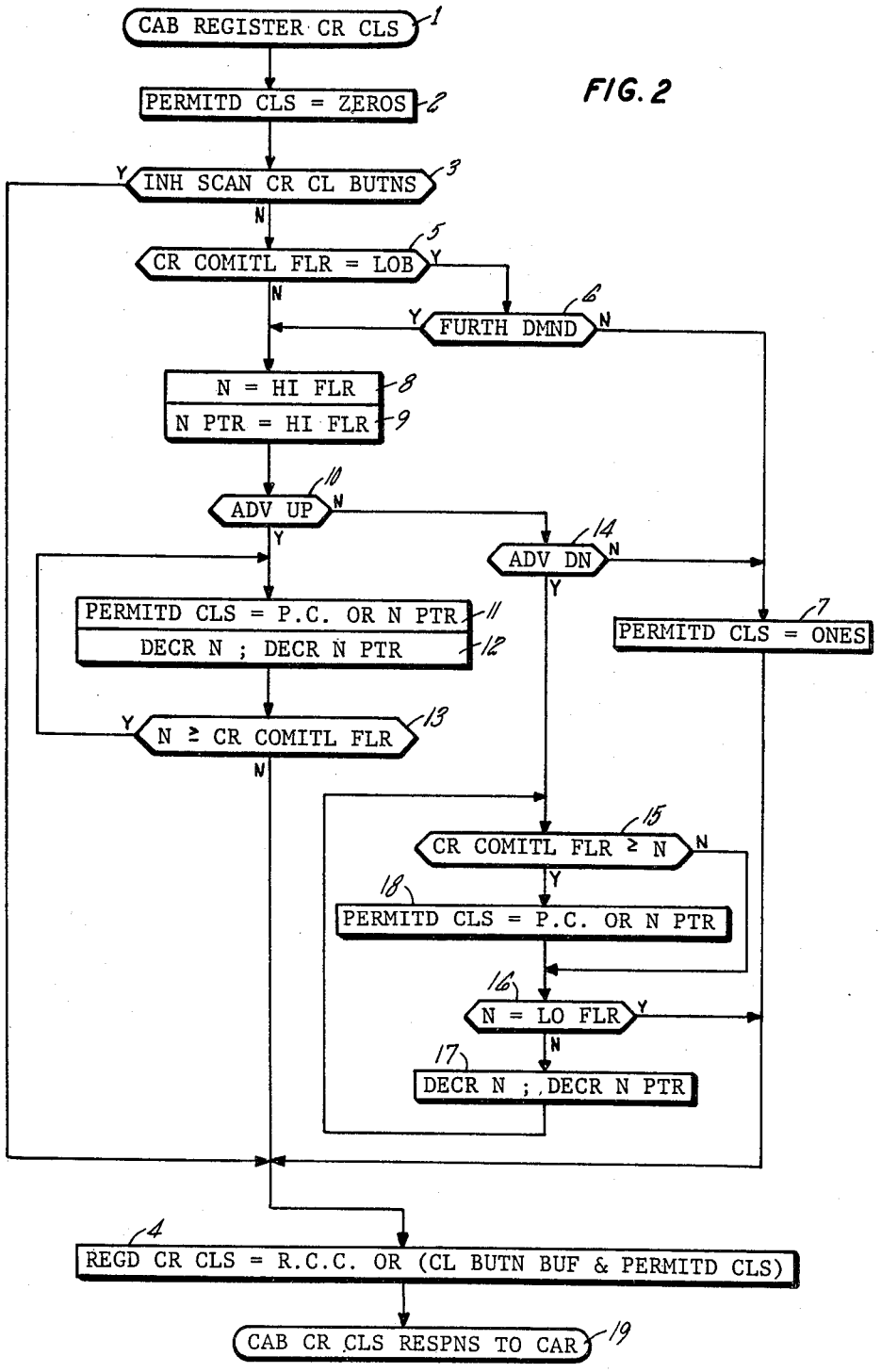
FIG. 2 is a simplified, logic flow diagram of a cab controller microprocessor routine for registering car calls.

After initialization a variety of elevatoring functions are performed by various routines on various time bases. Such routines include assigning cars to answer hall calls, parking cars in zones, handling up peak and down peak traffic, and various other functions, including the emergency priority service described hereinafter with respect to the present invention. The car controllers 15, 16 may be implemented in a fashion similar to that described hereinbefore with respect to the group controller 17, having I/O devices suitable for communication with the cab controllers 33, 34 over lines 13, 14 and suitable for interacting with circuitry for controlling the sheave/motor/brake assemblies 7, 8 as well as any related transducers, such as the primary position transducers 25, 26. The car controller has a principal task of controlling the motion of the cab, and at times controlling the cab door. These functions necessarily include other, known subfunctions such as recognizing car calls, and responding to car calls or floor calls assigned by the group (or otherwise) in conjunction with the position of the cab to cause the cab to open and close its doors at appropriate times. Since these functions, and the communications between the various controllers to effect them, are, except as provided hereinafter with respect to the present invention, generally known and within the skill of the art, no particular aspect of them being involved herein except as provided hereinafter, further discussion thereof is not otherwise provided herein. Referring now to FIG. 2, the first of a series of routines within the microprocessor of the cab controller 34, 35 (FIG. 1) that controls car calls begins with a cab register car calls routine reached through an entry point 1. A first step 2 sets a map of permitted calls to all zeros. This map, described more fully hereinafter, is a map of calls that are not behind the car in the car demand direction. A test 3 determines if the car controller (15, 16, FIG. 1) has sent down a directive to inhibit scan of car call buttons. This directive may, for instance result from step 19, FIG. 7 of a commonly owned, copending application entitled ELEVATOR EXPRESS PRIORITY SERVICE, Ser. No. 234,080 filed on even date herewith by Bittar and Nowak. If it has, an affirmative result of test 3 will reach a step 4 in which a map of registered car calls is set equal to itself ORed with the ANDed combination of a call button buffer map, (indicative of call buttons which the cab car call panel I/O has indicated as having been pressed) and the map of permitted calls (which in this case is all zeros as a consequence of step 2). The concept in the routine of FIG. 2 is that the registered car calls map is updated by any call buttons which have been pressed that are not excluded due to being omitted from the map of permitted calls. The call button buffer in the microprocessor of the cab controller (34 or 35, FIG. 1) simply reflects words transferred thereto from the panel I/O on a repetitive cyclic basis in ordinary communication routines. Whenever a button in a panel 40, 41 is in the pressed state, by virtue of the presence of a passenger's finger thereon, that fact is registered in the ensuing cycle within which the routine of FIG. 2 is performed, by having a bit indicative thereof in the appropriate floor position of the call button buffer. When the button is released, the next communication from the panel I/O to the call button buffer will not have a bit for the particular floor, so updating of the call button buffer will cause that floor not to be represented therein. Previously registered calls (not otherwise reset or inhibited as described hereinafter) are retained in the registered car calls map.

In FIG. 2, if scanning of car calls buttons is not inhibited, a negative result of test 3 will reach a test 5 for determining whether the car's committable floor is the lobby floor or not. If it is, an affirmative result of test 5 will cause a test 6 to determine whether the car has further demand (a need to run upward or downward) or not. If not, a negative result of test 6 will cause a step 7 to set the permitted calls map to all ones. Thus when a car is approaching the lobby and has no further demand, it will park at the lobby and await further use. Therefore, any calls are permitted since the car direction is not yet known until a passenger enters and decides whether to go up or down by selecting an appropriate floor. In this case, any new car call requests indicated by the call button buffer are added to the registered car calls in step 4 because all calls are permitted.

If the car is not approaching the lobby without further demand, either step 5 will be negative (the committable floor of the car is not the lobby) or step 6 will be affirmative (there is further demand). Then, the inhibition of car calls behind the direction of motion of the car becomes operative.

In FIG. 2, a step 8 sets a floor number, N, to the highest numbered floor of the building and a step 9 sets a floor pointer (N PTR) to the highest numbered floor of the building. Then a test 10 determines if the car motion direction is up or not. If it is, a step 11 adds to the previously zeroed map of permitted calls (step 2) the floor indicated by the N pointer by ORing the permitted calls map with the floor pointer. Then, a pair of steps 12 decrement the floor number and the floor pointer and a test 13 determines if the floor number is equal to or higher than the car committable floor. If it is, step 11 ORs another bit into the map of permitted calls representing the next lower floor in sequence. This proceeds iteratively until the floor number, N, is decremented to a point where it indicates a floor below the car committable floor. Thus, the floor represented by N when test 13 is negative is a floor which is behind the motion of the car. And, when test 13 is negative, the map of permitted calls will have added to it all of the floors from the top floor down to the committable floor of the car. Then, step 4 will update the registered car calls only by those floors in the map of the call button buffer which coincide with the map of permitted calls. Any attempt on the part of the passenger to register a car call for a floor equal to N (at the time that test 13 is negative), or any lower floor, will not be established in the map of registered car calls since it will have been omitted from the map of permitted calls.

In FIG. 2, in a similar fashion, if the car is not advancing upwardly, a negative result of test 10 will reach a test 14 which determines if the car is advancing downwardly. If it is, a similar permitted calls map is generated by starting at the lowest floor and adding bits to the map representative of every floor from the lowest floor to the committable floor of the car. Specifically, a test 15 determines whether the car committable floor is equal to or greater than the floor number represented by the N pointer. In the usual case, the car committable floor will be below the highest floor of the building so that initially test 15 has a negative result. This will test the value of N to see if it has been decremented to the lowest floor, but if not, a pair of steps 17 decrement N and the N pointer and test 15 is again made. Eventually N is decremented to the committable floor of the car so that step 15 will be affirmative. This will cause a step 18 to add to the map of permitted calls (which was reset to zeros in step 2) a bit at the position represented by the N pointer. Then unless the lowest floor is reached (test 16) steps 17 decrement N and the N pointer and test 15 is again performed for a next lower value of N. Subsequent to the first affirmative result of test 15, all subsequent passage through test 15 is affirmative so that as the N pointer is decremented down to the lowest floor, the map of permitted calls has added to it, successively, bits indicative of successively lower numbered floors in step 18. When the lowest floor is reached, the map of permitted calls is completed, step 16 will be affirmative, and step 4 will thus be reached.

In FIG. 2 if the car is not advancing upwardly or downwardly, having no demand and not running, test 14 will be negative and reach step 7 which causes the permitted calls to be a full map of ones, thus enabling any calls to be registered in step 4.

Figure 3:
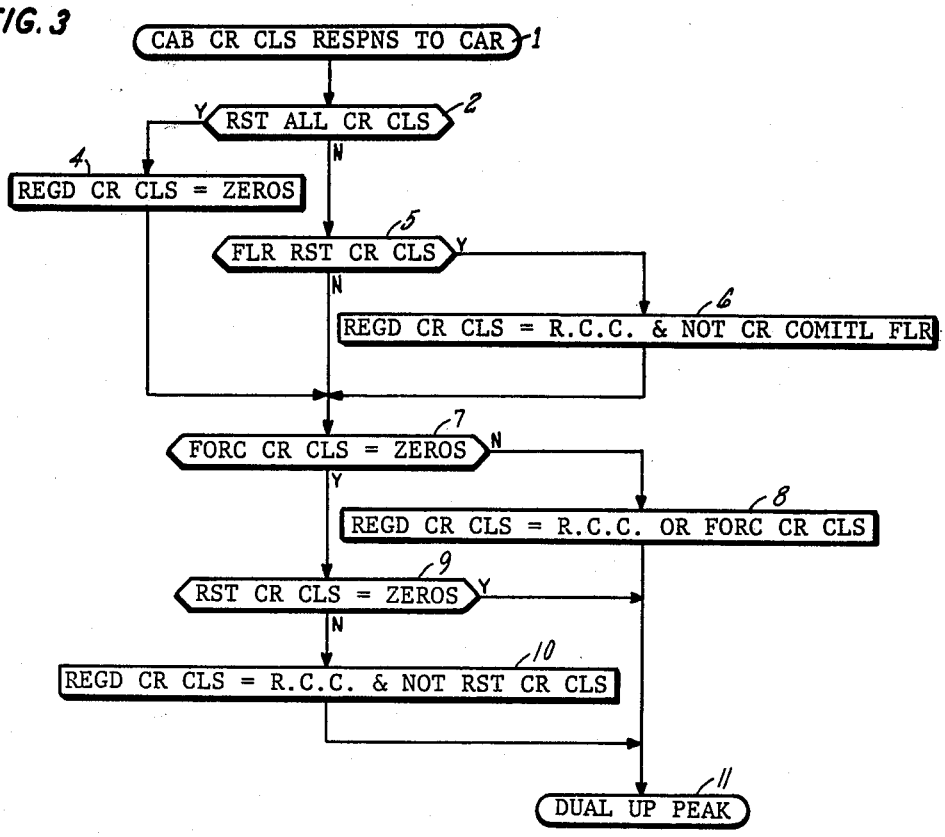
FIG. 3 is a simplified, logic flow diagram of a cab controller microprocessor routine for modifying registered car calls in response to directives from a car controller.

The routine of FIG. 2 thus allows updating (that is, adding to) the map of registered car calls, only those floors for which the call button buffer map indicates that call buttons are currently being depressed which coincide with permitted calls. And, permitted calls are limited to floors ahead of the committable position of the car in the direction in which it is advancing, except when the car is not advancing or is approaching the lobby with no further demand, in which case all calls are permitted. When step 4 has been completed in each pass through the routine of FIG. 2, a transfer point 19 (which may be a return point coupled with an appropriate sequence of routines) causes the cab car calls response to car routine of FIG. 3 to be reached through an entry point 1. In FIG. 3, a first test 2 determines if the car controller has sent down a directive to reset all car calls. This directive may be of the type indicated as subroutine 12 in FIG. 7 of the aforementioned ELEVA- TOR EXPRESS PRIORITY SERVICE application. In that case, all car calls are reset so as to permit setting a car call when the group determines that the car should answer an emergency priority service request. The setting of the car call is a mechanism by which the car is commanded to go to the floor where the emergency priority service is requested.

In FIG. 3 if all car calls are to be reset, an affirmative result of test 2 will reach a step 3 wherein the map of registered car calls (set in step 4 of FIG. 2) is reduced to all zeros. But if test 2 is negative, a test 5 determines whether the car has sent to the car a directive to reset a car call due to answering of such call. If it has, an affirmative result of test 5 will reach a step 6 wherein the map of registered car calls has the impending floor stop call removed therefrom by ANDing of itself with the complement of the map indicating the car committable floor. A test 7 determines if a map indicating car calls which should be foreced is all zeros or not. If it is not, a step 8 ORs that map with the map of registered car calls to have added, to the map of registered car calls, calls to the floors which are to be forced. The force car calls map tested in test 7 and utilized in step 8 may for instance be caused during emergency priority service by step 16 in FIG. 7 of the aformentioned ELEVATOR EXPRESS PRIORITY SERVICE application, which results from communication between the car controller and the cab controller which includes a map of force car calls bits to be used in test 7 and step 8.

In FIG. 3, a test 9 determines if a map of car calls to be reset is all zeros or not. If it is not, a negative result of test 9 reaches a step 10 in which the map of registered car calls has certain calls deleted therefrom by being ANDed with the complement of the map of car calls to be reset. The routine of FIG. 3 is then complete, having reset all car calls, reset the call at the floor where th car is about to stop, force selected car calls in response to the car controller, or reset selected car calls in response to the car controller. The program will then advance, either by return and calling the next program in sequence or directly, to the dual up peak routine through a transfer point 11.

Figure 4:
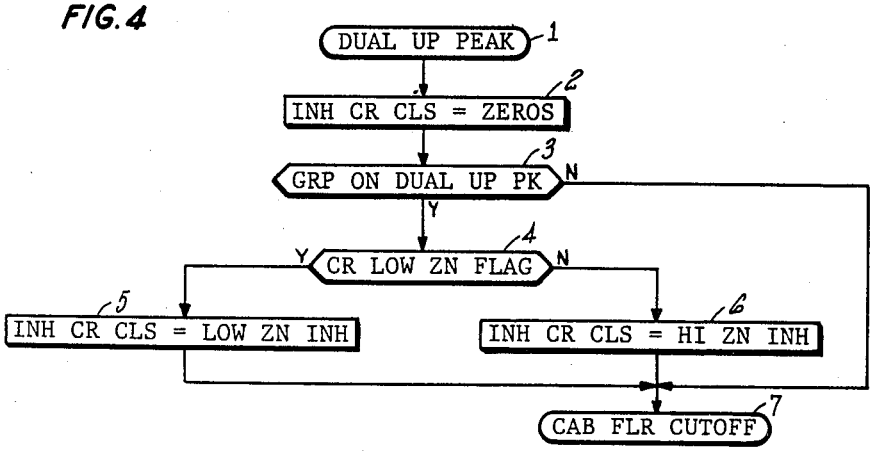
FIG. 4 is a simplified, logic flow diagram of a cab controller microprocessor routine for modifying car calls to implement dual up peak elevator operation.

In FIG. 4, the dual up peak routine is reached through an entry point 1 and a first step 2 resets a map of inhibited car call floors to all zeros. When a test 3 determines if the group has communicated to the car, and the car in turn has communicated to the cab, the fact that the group is on dual up peak mode of operation. This is a mode of operation which may utilize, for instance, the basic up peak dispatching described in a commonly owned U.S. patent application entitled VARIABLE ELEVATOR UP PEAK DISPATCHING INTERVAL, Ser. No. 99,394, filed on Dec. 3, 1979 by Bittar and Mendelsohn. In dual up peak, the only variation is that the cars are identified as being for passengers to reach a zone of lower floors or is identified as being for the passengers to reach a zone of upper floors. The dual up peak manipulation of car calls assures the fact that no car calls can be registered for the opposite zone. In other words, if one enters the car during dual up peak which is scheduled for low floor zone service, no car calls will be permitted above the low floor zone. Similarly, no calls are permitted below the lowest floor in the higher zone of a car which is servicing the higher numbered floors during dual up peak.

In FIG. 4 if the cab controller has been told that the group is on dual up peak dispatching, an affirmative result of test 3 will reach a test 4 in which a car low zone flag is interrogated. This flag is similarly sent from the group, to the car, to the cab to indicate to the cab whether this elevator is working as a low zone car or as a high zone car. Normally, the group itself will be told when dual up peak is in place and the cars will be designated as low zone or high zone cars in response to switch inputs made by a dispatcher on the lobby panel 21 (FIG. 1), but dual up peak may be controlled by a real time clock, and the designation of cars in the high or low zone can be permanently or semi-permanently established by maintenance switches, or read only memory fixed words, or in some other fashion.

In FIG. 4 if test 4 is affirmative, then a map of car calls to be inhibited is set equal to a low zone inhibit map in a step 5, and if test 4 is negative, the map of car calls to be inhibited is, instead, set to be equal to a high zone inhibit map in a step 6. When the dual up peak routine of FIG. 4 is completed by setting a map to inhibit car calls in either a high zone or a low zone, or resetting it to all zeros and leaving it that way, the program proceeds to the cab floor cutoff routine through a transfer point 7.

Floor cutoff (preventing car calls to prohibited floors, such as banking floors after hours) is controllable by switches on the lobby panel (21, FIG. 1) or in response to real time clock initiation thereof, as governed by maps of cars versus inhibited floors. The group controller must send directives to any involved car controller, which in turn sends directives to its cab controller to initiate or terminate cutoff of one or more floors.

Figure 5:
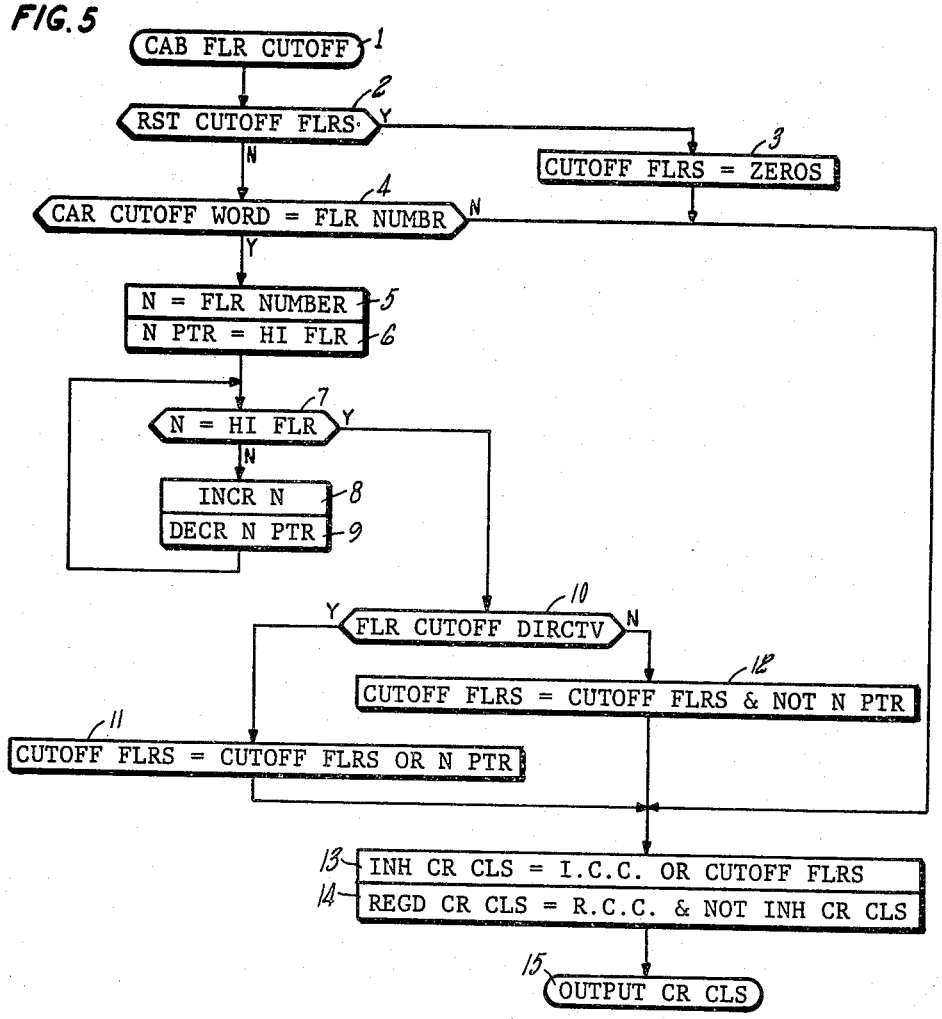
FIG. 5 is a simplified, logic flow diagram of a cab controller microprocessor routine for inhibiting car calls to implement floor cutoff operation.

In FIG. 5, the cab floor cutoff routine is reached through an entry point 1 and a first test 2 interrogates a directive sent to the cab from the car indicating that all cutoff floors should be reset. An affirmative result of test 2 causes a step 3 to reset a map of cutoff floors to all zeros. This has the effect of restoring all of the floors to service by the particular elevator car in question. If test 2 is negative, a test 4 determines whether a particular word sent to the car relating to the cutoff of service to certain floors has a valid floor number in it. If it does, the floor number indicated in the word which is interrogated in step 4 is utilized in a small routine to create a floor pointer indicating the floor of the floor number. Thus a number, N, is set equal to the floor number contained in the word, and an N pointer is set equal to the highest floor of the building in steps 5 and 6. Then a test 7 determines if the floor number, N, is equal to the highest floor of the building; if not, steps 8 and 9 increment the floor number and decrement the floor pointer. This continues until the floor number is equal to the highest floor of the building in which case an affirmative result of test 7 causes this iterative process to terminate. As a consequence, the N pointer is rotated left (to indicate a successively lower numbered floor) for each increment of N. Thus, if the floor number of the floor to be cut off is the 12th floor in a sixteen story building, the floor number would be incremented four times so that the N pointer would advance from 16 through 15, 14 and 13, to 12.

In FIG. 5, a test 10 interrogates a floor cutoff directive which is included with the floor number in a cutoff word sent from the car to the cab. If test 10 is affirmative, this indicates that the floor represented by the floor number is to be cut off from service. But if step 10 is negative, this indicates that the floor indicated by the floor number is to have its cutoff status removed, and again become available for service by this elevator.

Therefore, an affirmative result of test 10 will cause a step 11 to cause the map of cutoff floors to be updated by adding to it the floor indicated by the N pointer (indicating the floor number in the cutoff word) by having the N pointer ORed into it. But if test 10 is negative, a step 12 has the particular floor removed from the map of cutoff floors by ANDing the map of cutoff floors with the complement of the N pointer.

In FIG. 5, if test 2 indicates that the cutoff floors are not to be all reset, and test 4 does not find a valid floor number in a cutoff word sent down by the car, a negative result of step 4 causes the same steps 13–15 to be reached as is the case when either step 3 resets all of the cutoff floors or step 11 or 12 alters the map of cutoff floors. In step 13, the map of car calls to be inhibited (which may be established in steps 2 and 5 or 6 of FIG. 5) is updated by ORing it with a map of cutoff floors. And then the registered car calls map is updated by deleting any car calls which are inhibited (either as a result of cab floor cutoff or as a result of dual up peak) by ANDing the complement of the map of car calls to be inhibited with the map of registered car calls in a step 14. Then the routine is complete and the program may proceed to suitable other parts of the program, such as the output car calls routine, through a transfer point 15.

In FIG. 5, except when a cutoff directive (tests 4 and 10) is first sent to the cab controller by the car controller, or when all cutoff floors are restored (test 2), the map of cutoff floors will be retained, cycle after cycle. Thus, a floor can be cutoff by sending one directive (e.g., in the late afternoon) and it will remain cutoff until a restoring directive is sent (e.g. the following morning), due to the negative result of test 4 not altering the map of cutoff floors used in steps 13 and 14.

Figure 6:
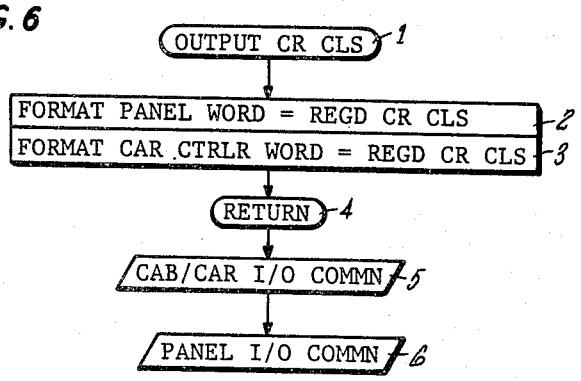
FIG. 6 is an exemplary, simplified, logic flow diagram illustrative of ancillary functions which may be performed in the cab controller in utilization of car calls modified in accordance with the invention.

The map of registered car calls is contemplated herein as being usable to indicate to the car controller (15, 16, FIG. 1), as well as to the car call button panel (40, 41, FIG. 1) within the cab, those floors for which valid car call commands are recognized. The car controller uses this information, for instance, to control stopping of the car at desired floors. This may be achieved in a fashion described in a commonly owned, copending U.S. patent application entitled ELEVATOR FLOOR STOP LOOK-AHEAD, Ser. No. 267,281, filed on May 27, 1981 by Sheehy and Bittar, or in any other suitable known fashion. Additionally, the registered car calls map is utilized at the panel (40,41, FIG. 1) to refresh the buttons (or adjacent lights) which are to be illuminated in the next cycle of operation. This is to say if the registered car calls map is reset to all zeros (such as in step 4 of FIG. 3), then all of the call button lights in the panel of the car will become dark in a next succeeding cycle. The manner of outputting the registered car calls map to the car and to the call button panel may take any suitable form, utilizing ordinary data communication techniques. As a mere example thereof, FIG. 6 illustrates that an output car calls routine, entered through a point 1, may have steps 2, 3 to format appropriate words including the map of registered car calls for transmission to the car call button panel and to the car controller, respectively. Thereafter, returning to the other parts of the program through a return point 4, other routines 5, 6 are reached which represent normal communications through I/O devices of the cab controller and the car controller to communicate the formatted word appropriately. In such a system, the depression of a call button may force a bit in a temporary call button register, the content of the temporary call button register being transferred from the car panel I/O to the microprocessor call button buffer (that referred to in step 4 of FIG. 2). The permitted calls, resets and inhibits controlling modification of the existing registered car calls map, and the modified registered car calls map may be returned to control the buttons or indicator lights for the various floors, as well as being sent to the car to indicate to the operation control portion of the car controller which car calls have been registered in the cab controller.

The use of "registered car calls" as the only source of landing stop directives (other than assigned hall call stops), with only permitted calls registered therein provides simplicity and correspondence between the permitted and phantom calls and the call panel indicators. Performing these functions within the car itself, in proximity to the car call panel allows indicating only accepted calls (as well as forced, phantom calls) without any undue delay (such as might occur if these functions were performed in the car controllers 15, 16, FIG. 1). Thus, the passengers know all calls and know that when their calls are indicated, they will be answered, and this occurs without the need to hold the car call button for more than one major cycle of the cab controller microprocessor (about one-fifth of a second).

As is apparent from the description of FIGS. 5 and 6 hereinbefore, the invention provides every elevator in the system with a capability for having any floor of the building prohibited to its passengers, in a manner which can be changed on a cycle by cycle basis. Thus, the invention provides a system which is instantaneously tailorable with respect to which cars are involved, and with respect to the particular prohibited floors for any car of the group. The invention is also compatible with car call controls which accommodate other necessary functions of an elevator system.

The generation of the floor pointer in steps and tests 7–9 of FIG. 5 is exemplary merely; the particular implementation of the function may be altered from that shown in FIG. 5 such as by utilizing table lookup to determine the correct floor pointer for a given floor number, or by utilizing directives which are formatted in a somewhat different fashion. The invention may also be implemented with dedicated digital or analog hardware, in a fashion similar to that described hereinbefore.

Thus although the invention has been shown and described with respect to exemplary embodiments thereof, it should be understood by those skilled in the art that the foregoing and various other changes, omissions and additions may be made therein and thereto, without departing from the spirit and the scope of the invention.

We claim:

1. An elevator system including a group of elevators movable in shaftways for servicing a plurality of floor landings in a building, comprising:

group controller means for designating one or more specific elevators which are to be excluded from providing service to selected cutoff floors and for providing floor cutoff signals indicative thereof to each one of said specific elevators;

each elevator including a car, a car call panel having passenger-actuable means for providing car call button signals indicative of landings at which elevator stops are requested by passengers and for providing visual indications to the passengers of landings for which car calls have been requested, motion means for moving and stopping said car in the related shaftway for servicing the landings, and signal processing means interconnected with said motion means and responsive to said car call button signals for providing registered car call signals, and for providing signals to said motion means to cause movement of said car to landings corresponding to said registered car call signals;

characterized by:

each of said signal processing means comprising means responsive to said floor cutoff signals provided thereto by said group controller means for eliminating those registered car call signals corresponding to floors designated by said floor cutoff signals as being inaccessible.

2. An elevator system according to claim 1 characterized by:

said group controller comprising means to provide, to said elevators, floor cutoff signals which designate a floor and which designate whether service to said floor by the related elevator is to be alternatively cut off or restored; and each of said signal processing means comprising means for providing a register of cutoff signals corresponding to floors designated in said floor cutoff signals provided thereto by said group controller which indicate that the designated floor is to be cut off, for eliminating, from said register of cutoff signals, signals corresponding to floors designated in said floor cut-off signals provided thereto by said group controller which indicate that the designated floor is to be restored to service by the related elevator, and for eliminating those registered car call signals corresponding to floors designated by said register of cutoff signals.

3. An elevator system according to claim 2 characterized by:

said group controller comprising means to provide, to said elevators, cutoff reset signals indicative of the fact that all floors are to be restored to service by the elevator to which said cutoff reset signals are provided; and each of said signal processing means comprising means for eliminating all floor designating signals from said register of cutoff signals in response to said cutoff reset signals being provided thereto.

* * * * *